United States Patent [19]

Nakamura et al.

[11] 4,125,005

[45] Nov. 14, 1978

[54] LOCK DEVICE OF THE PUSHBUTTON SYSTEM

[76] Inventors: Katori Nakamura; Hisako Nakamura, both of No. 18-17 Okuzawa 6-chome, Setagaya-Ku, Tokyo, Japan

[21] Appl. No.: 809,039

[22] Filed: Jun. 22, 1977

[30] Foreign Application Priority Data

Dec. 2, 1976 [JP] Japan ..... 51-144895

[51] Int. Cl.[2] ..... E05B 37/16

[52] U.S. Cl. ..... 70/133; 70/298; 70/313

[58] Field of Search ..... 70/115, 119, 122, 126, 70/133, 138, 297, 298, 299, 313

[56] References Cited

U.S. PATENT DOCUMENTS

| | | | |
|---|---|---|---|
| 1,092,733 | 4/1914 | McCarthy | 70/298 X |
| 1,401,030 | 12/1921 | Ashkar | 70/298 X |
| 1,513,904 | 11/1924 | Hill | 70/298 X |
| 1,538,479 | 5/1925 | Fleury | 70/297 |
| 2,997,872 | 8/1961 | Fry | 70/298 X |
| 3,009,346 | 11/1961 | Check | 70/298 X |
| 3,667,261 | 6/1972 | McGourty | 70/313 X |
| 3,808,852 | 5/1974 | Mohrhauser | 70/313 X |
| 3,910,078 | 10/1975 | Shulz | 70/298 X |

FOREIGN PATENT DOCUMENTS

| | | | |
|---|---|---|---|
| 372,613 | 3/1923 | Fed. Rep. of Germany | 70/119 |
| 55,499 | 5/1975 | Japan | 70/299 |

*Primary Examiner*—Thomas J. Holko

*Attorney, Agent, or Firm*—Toren, McGeady and Stanger

[57] ABSTRACT

A mechanical lock device dispensing with a key, wherein a locking and unlocking bar associated with at least one lock unit and a locking and unlocking pawl connected to such bar can be angularly rotated by depressing, in a proper order, pushbuttons of a number *r* out of a total number *n*, whereby anybody can operate from outside a dead bolt in a manner to withdraw the same from the mortise. The locking and unlocking pawl is held in engagement within a cutout formed in a control slider fitted in a stem portion of the dead bolt and also in a plurality cutouts formed in the stem portion of the dead bolt and having a larger width than the cutout formed in the control slider. The control slider can be operated by turning a grip. The dead bolt itself can be operated from inside the room irrespective of the position where the locking and unlocking pawl is disposed. The dead bolt can be fitted into a mortise and the lock units can be reset by the reciprocating motion of a lever operated by turning a knob.

10 Claims, 28 Drawing Figures

LOCK DEVICE OF THE PUSHBUTTON SYSTEM

BACKGROUND OF THE INVENTION

This invention relates to a purely mechanical lock device of the pushbutton system dispensing key and more particularly to a lock device of the type described which is of a mortise lock type.

Lock devices of the prior art generally consist of a lock body attached to one of two members to be fastened or unfastened so as to close or open them, and a key belonging to the lock body for operating the same. Some disadvantages are accompanied with the lock devices of this type of the prior art. If the user misplaces or loses his key, he will be at a loss because he is unable to unlock the locked members until the right key is found. The user may sometimes find it hard to fit the key into the keyhole at night because of darkness. The user will be unable to unlock the locked member single-handed if he wants to do so.

In this connection, lock devices are known which dispense with a key, and requirements to be met for rendering the devices operative or inoperative are set electrically or magnetically so that the order in which the pushbuttons are depressed may correspond to the key. However, lock devices of this type are not suitable for practical use because they need a power source.

A proposal has been made to use a padlock as a mechanical lock device of relatively compact size which dispenses with a key. Such padlock (Japanese Laid-Open patent application No. 55499/75) comprises two lock units and is constructed in such a manner that pushbuttons of a number $r$ out of a total number of $n$ are mechanically operated to meet the requirements for rendering the padlock inoperative which conform to the permutation. However, there are still a number of problems which must be solved for providing a lock device of the mortise lock type by using the lock units disclosed in this laid-open patent application. This invention provides solutions to these problems.

SUMMARY OF THE INVENTION

An object of this invention is to provide a practical lock device of the mortise lock type using at least one lock unit of a purely mechanical pushbutton system dispensing with a key.

Another object is to provide a lock device of the type described which comprises a mechanism permitting the latch bolt to be operated when a grip for opening and closing the door is turned.

Another object is to provide a lock device of the type described which comprises a mechanism permitting the dead bolt to be operated when the grip of the door is turned, so long as the lock units are each in an inoperative position.

Still another object is to provide a lock device of the type described which comprises a mechanism permitting withdrawing of the dead bolt from the mortise to be effected freely from inside the door.

Still another object is to provide a lock device of the type described which comprises a mechanism permitting, by operating from inside and outside the door, the lock units to be brought to a standby position and inoperative by depressing the pushbuttons again, after the requirements for rendering the lock units inoperative have been met or have not been met by the previous pushbutton depression.

A further object is to provide a lock device of the type described in which a plurality of lock units are interchangeably mounted and the lock device as a whole is rendered inoperative when all the lock units meet the requirements for being rendered inoperative.

Additional and other objects and features of the invention will become apparent from the description set forth hereinafter when considered in conjunction with the accompanying drawings.

BRIEF DESCRIPTION OF THE DRAWINGS

FIG. 14 and FIG. 16 are views in explanation of the offset portions of the driving slider in engagement with the pressure projections;

DETAILED DESCRIPTION OF THE PREFERRED EMBODIMENT

To enable the present invention to be better understood, the padlock disclosed in Japanese Laid-Open patent applicaion No. 55499/75 will be first described by referring to FIG. 1 to FIG. 8.

Figure 1:
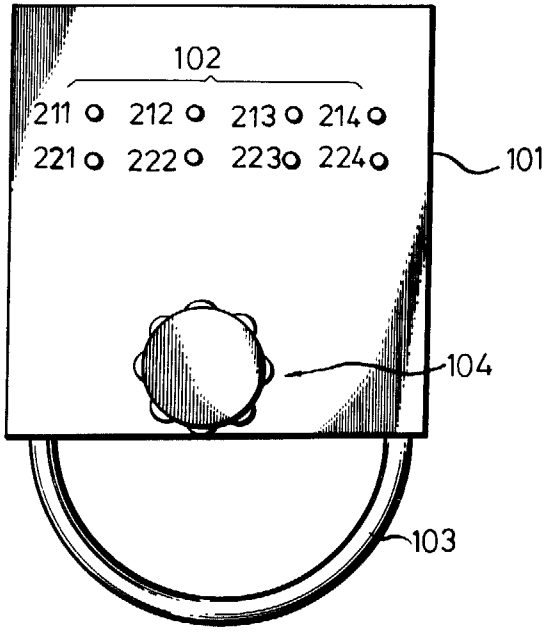
FIG.1 PRIOR ART
FIG. 1 is a front view of a padlock of the pushbutton system of the prior art.

In FIG. 1, the padlock comprises a casing 101, and pushbuttons 102 which are *n* in number and project outwardly through the casing 101. The padlock also comprises a link 103 which can be withdrawn from the casing only when the pushbuttons 102 of a number *r* or 5, for example, are depressed in the proper order, whereby the closed loop can be broken or the padlock can be rendered inoperative. The numeral 104 designates a restoring mechanism for returning the padlock from its inoperative position to a standby position in which the padlock can be rendered inoperative again by despressing the pushbuttons in accordance with a predetermined pattern.

Figure 2:
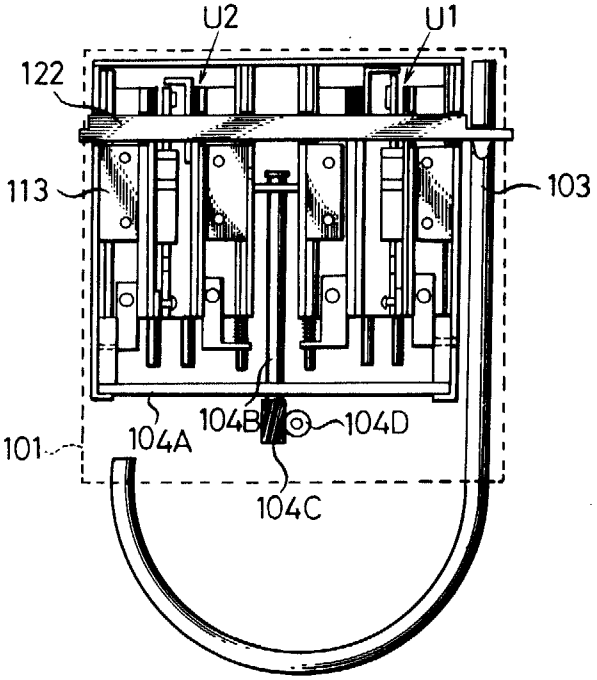
FIG.2 PRIOR ART
FIG. 2 is a rear view of the padlock shown in FIG. 1, with its rear cover being removed.
Figure 3:
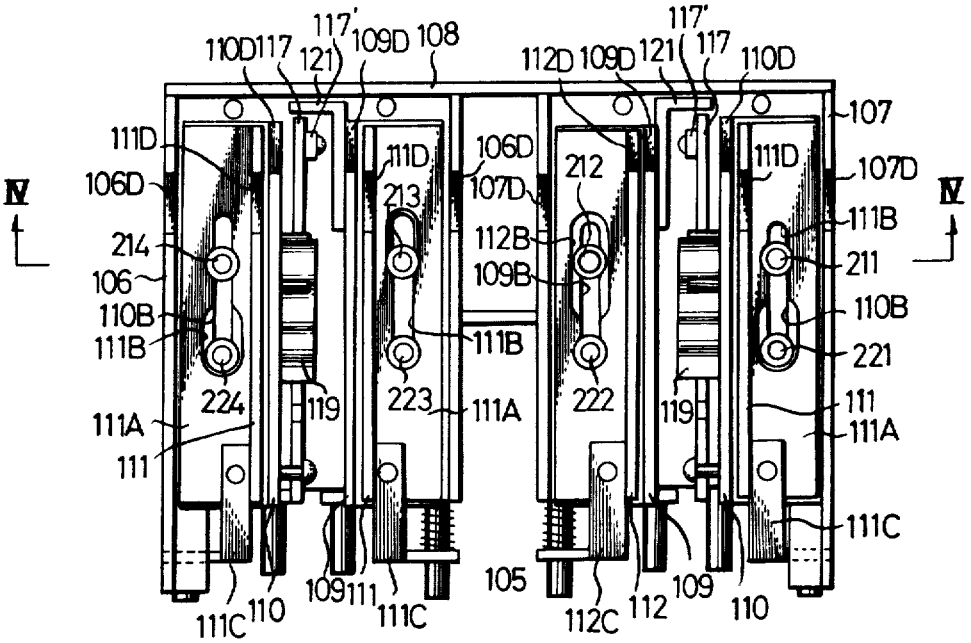
FIG.3 PRIOR ART
FIG. 3 is an enlarged view of FIG. 2, with the guiding and holding plate being removed.

In FIGS. 2 and 3, two lock units U1 and U2 are arranged in side-by-side relation within the casing 101 such that there is a clearance space 105 between the two lock units. The two lock units U1 and U2 include base plates 106 and 107 respectively which are fastened by screws to a common base plate 108.

The lock unit U2 located on the left side in FIG. 3 comprises a permutation driving element 109, a permutation driven element 110 and two locking and unlocking bar rotation preventing elements 111. Meanwhile the lock unit U1 which is located on the right side of FIG. 3 comprises a permutation driving element 109, a permutation driven element 110, a locking and unlocking bar rotation preventing element 111 and a locking and unlocking bar releasing element 112. These elements of the lock units U1 and U2 are arranged parallel to the base plate 106 and 107 and can be moved upwardly or downwardly along the plane of FIG. 3. The permutation driving and driven elements will be hereinafter referred to as driving and driven elements, respectively, and the locking and unlocking bar rotation preventing elements and the locking and unlocking bar releasing elements will be hereinafter referred to as preventing and releasing elements, respectively.

Figure 6:
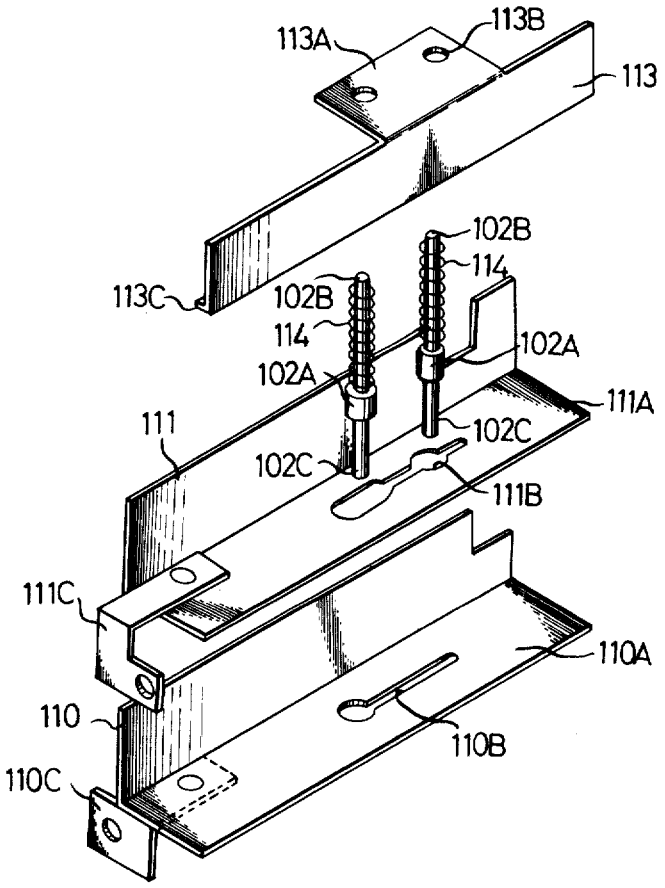
FIG.6 PRIOR ART
FIG. 6 is an exploded view of the portion of the lock units shown in FIG. 3.
Figure 7:
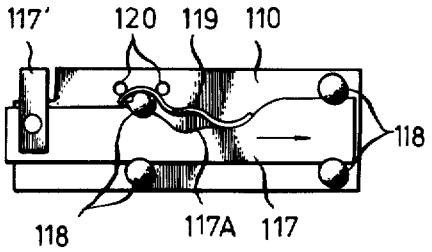
FIG.7 PRIOR ART
FIG. 7 is a side view, on an enlarged scale, of the permutation driven element of the lock units shown in FIG. 3.

The driving element 109, driven element 110, preventing element 111 and releasing element 112 are each formed of a plate, and tongues 109A, 110A 111A and 112A extend toward an upright portion of the U-shaped base plate 106 or 107 from the lower side edges (on the side at which the elements are in contact with a bottom member of the U-shaped base plate 106 or 107) of the plate-like elements 109, 110, 111 and 112 respectively in such a manner that the plate body and the tongue are in the form of a letter L in cross section. As can be seen in FIG. 6, the tongues 109A, 110A, 111A and 112A are formed therein with openings 109B, 110B, 111B and 112B of a complex form, respectively, which extend in a direction in which the various element move. Each of these openings include a major diameter portion and a minor diameter portion.

The preventing element 111 or releasing element 112 is superposed on the driving element 109, and the preventing element 111 is superposed on the driven element 110 in a manner shown in FIG. 6. Two pushbuttons 102 extend through the two openings in the upper and lower elements. The pushbuttons 102 each include a base portion 102A, and minor diameter stem portions 102B and 102C extending in opposite directions from the base portion 102A (See FIG. 6). Each minor diameter stem portion 102B is received in one of a plurality of guide openings 113B formed in a ledge 113A extending from a guiding and holding plate 113 at a right angle thereto, while the other minor diameter stem portions 102C each extend through the casing 101 and outwardly thereof as shown in FIG. 1. A spring 114 surrounding each minor diameter stem portion 102B is mounted between the ledge 113A of the guiding and holding plate 113 and the base portion 102A of the pushbutton 102, so that the base portion 102A of each pushbutton 102 is urged to press against the preventing element 111, releasing element 112, driving element 109 or driven element 110.

When the elements are in a standby position, the base portion 102A of each of pushbuttons 211, 213, 222 and 223 of the pushbutton matrix shown in FIG. 1 extends through one of the major diameter portions of the openings 111B or 112B formed in the upper tongue 111A or 112A and is seated on the lower tongue 109A or 110A. The base portion of each of the pushbuttons 212, 213, 221 and 224 extends through the openings 111B and 110B, 112B and 109B, 111B and 109B or 111B and 110B formed in the tongues of the upper and lower elements. That is, each base portion extends through the major diameter portion of these openings and is seated at the bottom of the base plate 106 or 107 (See FIGS. 3 and 4).

More specifically, in the lock unit U1, the pushbuttons 211 and 221 belong to the preventing element 111 and driven element 110 respectively, and the pushbuttons 212 and 222 belong to the driving element 109 and releasing element 112 respectively. On the other hand, in the lock unit U2, the pushbutton 213 belongs to the driving element 109, the pushbutton 223 belongs to the preventing element 111 superposed on the element 109, the pushbutton 214 belongs to another preventing member 111 and the pushbutton 224 belongs to the driven element 110.

Figure 5:
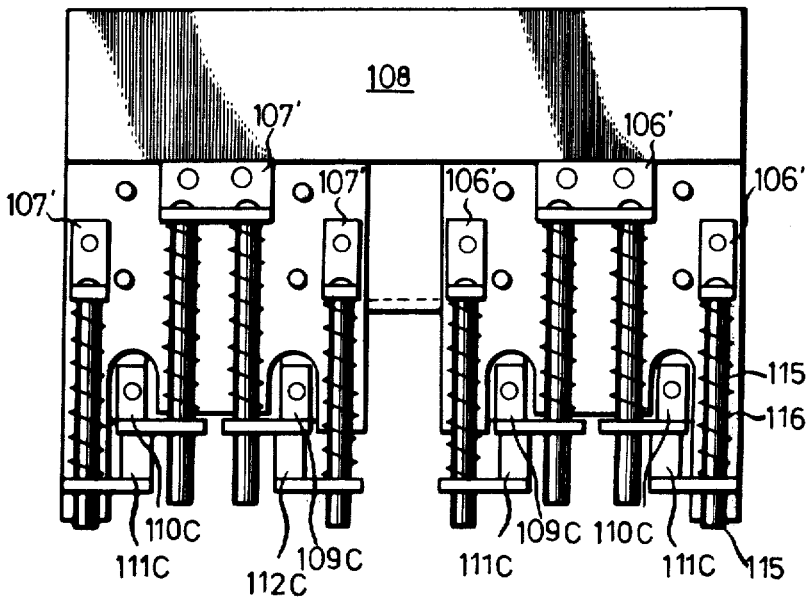
FIG.5 PRIOR ART
FIG. 5 is a front view, on an enlarged scale, of the padlock shown in FIG. 1, with the casing being moved.

Each of the elements 109, 110, 111 and 112 has attached to one end thereof an auxiliary plate member 109C, 110C, 111C or 112C which straddles the base plate 106 or 107 in a manner to be bent and extend outwardly from the respective element (See FIGS. 3, 5 and 6). Coil springs 116 each surrounding one of support rods 115 are mounted between the auxiliary plate members and support plates 106' and 107' and secured to outer surfaces of the base plates 106 and 107 respectively and extending outwardly therefrom. All the elements 109, 110, 111 and 112 are urged by the biasing forces of the springs 116 to move downwardly along the plane of FIG. 5. However, since the base portions of the pushbuttons are locked by offset portions formed between the major diameter portions and the minor diameter portions of the openings formed in the tongues of the elements, the elements are kept in the standby position. Each element can move from the standby position to a lowermost position if the minor diameter stem portion 102C of each pushbutton is pushed from outside and the minor diameter stem portion 102C of the respective pushbutton is urged by the biasing force of the associated spring 116 to move into corresponding minor diameter portion of the opening formed in the tongue.

Figure 4:
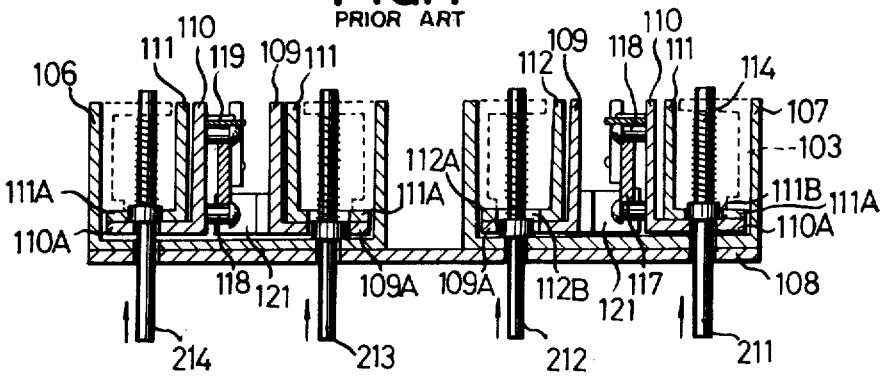
FIG.4 PRIOR ART
FIG. 4 is a sectional view taken along the line IV—IV of FIG. 3.

As can be seen in FIGS. 4 and 6, the two elements superposed one over the other on the driven element 110 and preventing element 111 of lock unit U1, for example, are held stably in position by the associated guiding and holding plate 113 located near the side edges of the tongues. More specifically, the plate 113 includes a guide edge 113C formed at the lower end thereof for preventing the vertical movement of the superposed elements, while the side edge of the ledge 113A and the pushbutton 102 prevent the transverse movement of the superposed elements. The holding plates 113 are secured to the base plate 106 or 107.

A sliding plate 117 is located on a side of each driven element 110 opposite the tongue 110A thereof (See FIGS. 3 and 4). Each sliding plate 117 is carried by headed pins 118 which function as guiding and supporting members secured to the driven member 110, and is capable of moving one stage relative to the element 110 transversely in FIG. 7. The stable position in which the sliding plate 117 is disposed after moving one stage is defined by a W-shaped cutout 117A and a plate spring 119 adapted to be brought into pressing engagement with the cutout 117A. The plate spring 119 is secured at one end to one of the headed pins 118 by means of auxiliary pins 120.

Figure 8:
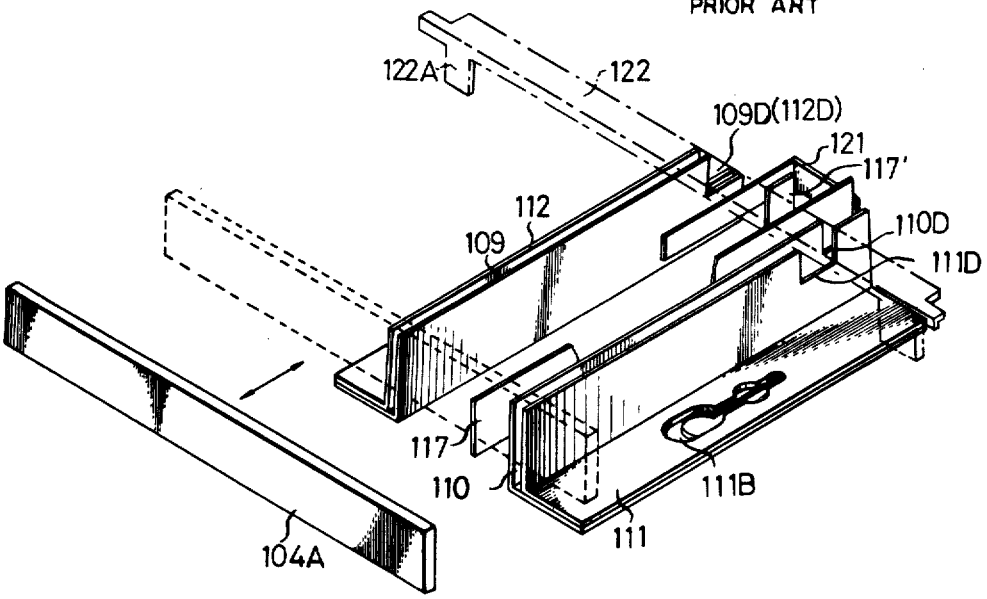
FIG.8 PRIOR ART
FIG. 8 is a view showing the relative positions of the locking and unlocking bar and various elements shown in FIG. 2.

The driving element 109 has mounted in an upper portion of a side thereof opposite the tongue 109A and L-shaped arm 121 which includes a smaller length portion abutting against the head of the sliding plate 117 so as to be able to move the sliding plate 117 together in a downward direction (See FIGS. 3 and 8).

The eight elements 109, 110, 111 and 112 and the two base plates 106 and 107 are formed at the upper ends thereof with cutouts 109D, 110D, 111D and 112D and 106D and 107D respectively for permitting the locking nad unlocking bar 112 to rotate (See FIGS. 2 and 8). The locking and unlocking bar 122 rotatably supported at opposite ends thereof by the casing 101 (FIGS. 2 and 8) is disposed such that it is located above (as seen in a direction perpendicular to the plane of FIG. 3) the cutouts in these elements and at a right angle thereto. The locking and unlocking bar 122 has no projections or recesses in its main portion and has attached to either end a lever portion 122A (FIG. 8) extending downwardly at a right angle to the plane of the bar 122 in the form of a letter L in cross section. The locking and unlocking bar 122 is engaged by the link 103 and urged by the biasing force of a spring (not shown) to cause the link 103 to be withdrawn into the casing 101.

The cutouts in the base plates 106 and 107 and the elements 109, 110, 111 and 112 are formed in position such that, when the lock units are in the standby position, the cutouts 106D 107D and 111D are disposed immediately below the locking and unlocking bar 122 while the cutouts 109D, 110D and 112D are disposed upwardly in FIG. 3 by one stage relative to the bar 122. The locking and unlocking bar 122 is unable to rotate unless all the cutouts are disposed immediately below it. Therefore, with respect to the side edge of each element which is disposed on the side of the locking and unlocking bar 122, a portion of such side edge which is disposed above the cutout 111D by one stage and a portion thereof which is disposed below the cutouts 109D, 110D and 112D by one stage will be hereinafter referred to as preventing portions of the respective elements. The numeral 117' designates a preventing portion of each sliding plate 117, and a portion of the sliding plate 117 located above the preventing portion 117' does not prevent the rotation of the locking and unlocking bar 122.

The preventing portions of the driving elements 109, driven elements 110 and releasing element 112 are disposed on the planar main portion of the locking and unlocking bar 122 when the lock units U1 and U2 are in the standby position, thereby preventing the rotation of the locking and unlocking bar 122. When these preventing portions have moved to the lowermost position, they are not disposed above the main portion of the bar 122, thereby releasing the bar 122 from the position in which its rotation is prevented. Conversely, when the lock units U1 and U2 are in the standby position, the cutout 111D of each preventing element 111 is disposed immediately below the locking and unlocking bar 122 so as to permit the bar 112 to rotate. However, when the preventing elements have moved to the lowermost position, the preventing portions of the elements 111 are disposed below the bar 122, thereby preventing the rotation thereof.

The padlock constructed as aforesaid operates as described below. For the sake of convenience of explanation, the lock units or all the elements are assumed to be in the standby position, and the requirements of bringing the padlock to an inoperative position are to depress the pushbuttons 212, 221, 222, 213 and 224 in the indicated order.

First, let us assume that the aforesaid five proper pushbuttons have been depressed in the proper order. Upon the first proper pushbutton 212 being depressed against the biasing force of spring 114, the base portion 102A thereof is released from engagement with the opening 109B of the driving element 109 (FIG. 4) and permits the driving element 109 of the lock unit U1 to move downwardly a distance corresponding to the length of the minor diameter portion of the opening 109B or by one stage to its lowermost position by virtue of the biasing force of spring 116. Thus the preventing portion of the element 109 moves away from beneath the bar 122, and the arm 121 belonging to it pushes downwardly the sliding plate 117 of the driven element 110. That is, in FIG. 7, the sliding plate 117 moves downwardly against the biasing force of plate spring 119 as it is pushed by the arm 121, until a free end of plate spring 119 is fitted into a second depressed portion of the cutout 117A. At this time, the sliding plate 117 stops, and the preventing portion 117' also moves downwardly by one stage into a position which is directly below the locking and unlocking bar 122. Even if the first proper pushbutton 212 is depressed, the locking and unlocking bar 122 is unable to rotate, because its rotation is prevented by the preventing portion 117' of the sliding plate 117, the preventing portions of elements 110 and 112 of lock unit U1, and the preventing portions of elements 109 and 110 of lock unit U2.

Next, if the second correct pushbutton 221 is depressed, then the base portion 102A thereof is released from engagement in the opening 110B in the driven member 110. This causes the driven member 110 of lock unit U1, which has been engaged therein, to be moved downwardly by one stage to the lowermost position by the biasing force of spring 116. Thus the preventing portion of driven element 110 moves away from below the locking and unlocking bar 112 and the cutout 110D moves to a position immediately below the bar 122. At the same time, the sliding member 117 which is carried through the pins 118 by the driven member 110 moves together with the driven member 110, so that the preventing member 117' thereof moves away from beneath the bar 122.

Then, if the third proper pushbutton 222 is depressed, the releasing element 112 which belongs to it moves downwardly by one stage as is the case with the aforesaid driven element 110, so that the preventing portion thereof moves away from below the bar 122. That is, as the base portion 102A is released from engagement in the opening 112B, the releasing element 112 moves by one stage to the lowermost position, and the cutout 112D moves to a position which is below the bar 122. Thus lock unit U1 is brought to an inoperative position.

Thereafter, if the fourth proper pushbutton 212 is depressed, the driving element 109 of lock unit U2 belonging thereto moves downwardly by one stage to the lowermost position in the same manner as when the pushbutton 212 was depressed, and the associated arm 121 moves the sliding plate 117 downwardly by one stage. Thus the preventing portion of driving element 109 moves away from below the bar 122 and at the same time the preventing portion 117′ of the sliding plate 117 moves to a position which is disposed below the bar 122.

Finally, if the fifth proper pushbutton 224 is depressed, the driven element 110 of lock unit U2 belonging thereto moves downwardly by one stage to the lowermost position in the same manner as when the pushbutton 221 was depressed, and the preventing portion of the driven member 110 moves away from below the bar 122. At the same time, sliding member 117 carried by the driven element 110 moves therewith, with the preventing portion 117′ thereof moving away from below the bar 122. Thus lock unit U2 is brought to an inoperative position. Now that the two lock units U1 and U2 are both in the inoperative position, the locking and unlocking bar 122 can be rotated and the link 103 can be withdrawn from the casing 101.

Let us now explain what will happen if the proper pushbuttons are depressed in a wrong order. By the proper pushbutton being depressed in a wrong order it is understood a situation arises in which the driven element 110 will be actuated before the driving element 109 is actuated for each of the two lock units U1 and U2. For example, this happens when the pushbutton 221 is first depressed and then the pushbutton 212 is depressed.

If the proper pushbutton 221 is depressed, the base portion 102A thereof is released from engagement within the opening 110B and the driven member 110 moves downwardly by one stage to the lowermost position. This causes the sliding plate 117 belonging thereto to move downwardly by one stage therewith. However, since the sliding plate 117 was merely moved downwardly by the arm 121 of the driving element 109, the preventing portion 117′of the sliding plate 117 moves to a position disposed below the locking and unlocking bar 122. If the proper pushbutton 212 is depressed at this time, the driving element 109 moves downwardly by one stage to the lowermost position. However, since the sliding plate 117 has already moved downwardly by one stage with the driven element 110 as mentioned above, the arm 121 is unable to move the sliding plate 117 downwardly. Thus the preventing portion 117′ of the sliding plate 117 is unable to move away from below the bar 122. Therefore, it is impossible to rotate the locking and unlocking bar 122.

Now the case will be described in which other pushbuttons than the proper pushbuttons are depressed. For example, let us assume that the pushbutton 211 is depressed because the operator is not aware of the proper order for depressing the pushbuttons. In this case, the preventing element 111 of the lock unit U1 belonging thereto moves downwardly by one stage and its preventing portion moves to a position which is disposed below the locking and unlocking bar 122. Thus, this makes it impossible to cause the bar 122 to rotate, even if the pushbuttons have been depressed in the proper order up to then even if the pushbuttons are depressed in the proper order thereafter. To render the locking and unlocking bar rotatable, it is essential that the releasing element 112, which is one of the elements belonging to the proper pushbuttons, should be actuate. It will be appreciated that the provision of the two types of elements or preventing element 111 are releasing element 112 makes complex the requirements for rendering the lock device inoperative. Stated differently, at least one of the five preventing portions consisting of two preventing portions 117′ of the sliding plates 117 and the three preventing portions of the preventing elements 111 for two lock units U1 and U2 prevents the rotation of the bar 122.

A restoring mechanism 104 is provided for returning to the standby position the driving and driven elements 109 and 110, the preventing elements 111 and releasing element 112 which have moved to the lowermost position. The restoring mechanism 104 comprises a pushup member 104A arranged at the rear ends of the base plates 106 and 107 in a manner to be disposed at a right angle to the longitudinal axes of the elements 109, 110, 111 and 112, a push-up member guide rod 104B threadably connected to the member 104A and disposed parallel to the longitudinal axes of the elements 109, 110, 111 and 112, gearing 104C for moving the guide rod 104B in a direction parallel to the longitudinal axes of the elements 109, 110, 111 and 112, and a shaft 104D for supporting a knob at one end thereof (See FIGS. 1 and 2).

By turning the shaft 104D of the knob counterclockwise, for example, it is possible to move the push-up member 104A from a solid line position to a broken line position in FIG. 8.

If the link 103 is fitted in the casing 101 to form a closed loop and then the push-up member 104A is moved upwardly to a position in which it is in contact with the lower ends of the base plates 106 and 107, all the elements in the lowermost position can be moved upwardly to the standby position shown in FIG. 3. As a result, the base portions 102A of the pushbuttons 102 move from the minor diameter portions to the major diameter portions of the openings formed in the tongues 109A, 110A, 111A and 112A and are locked in position in the major diameter portions. At this time, the lower ends of the base portions 102A are urged by the biasing force of the respective springs 114 to move into the major diameter portions of the openings to which they belong, so that the base portions 102A are snugly fitted therein. If the push-up member 104A is returned to the solid line position thereafter, the edges of the major diameter portions are brought into locking engagement with the edges of the base portions 102A of the pushbuttons 102, with the result that all the elements are restored to the standby position in which they are capable of moving to the lowermost position again to permit the locking and unlocking bar 122 to rotate if the proper pushbuttons are depressed in the proper order, thereby rendering the lock units U1 and U2 inoperative.

In the padlock of the pushbutton system constructed as mentioned above, some of the proper pushbuttons must be depressed in the order which conforms to permutation. Therefore, even if the proper pushbuttons are found, it is impossible to render the padlock inoperative unless the order in which the pushbuttons are depressed meets the requirements for rendering the padlock inoperative. Also, even if one knows that the padlock consists of two lock units and that each lock unit can be rendered inoperative by depressing two pushbuttons in a predetermined order, there are $4P_2$ 12 combinations for one lock unit or 12 × 12 = 144 combinations for the two lock units for the order in which the pushbuttons are depressed. Unless one knows the proper order in which the proper pushbuttons are to be depressed, one cannot render the padlock inoperative. However, since the number of buttons necessary for rendering the padlock inoperative is relatively small, it is easy to remember the order of depressing the pushbuttons in the order which conforms to permutation.

The lock device according to the present invention will now be described with reference to a preferred embodiment shown in FIGS. 9 to 11.

Figure 9:
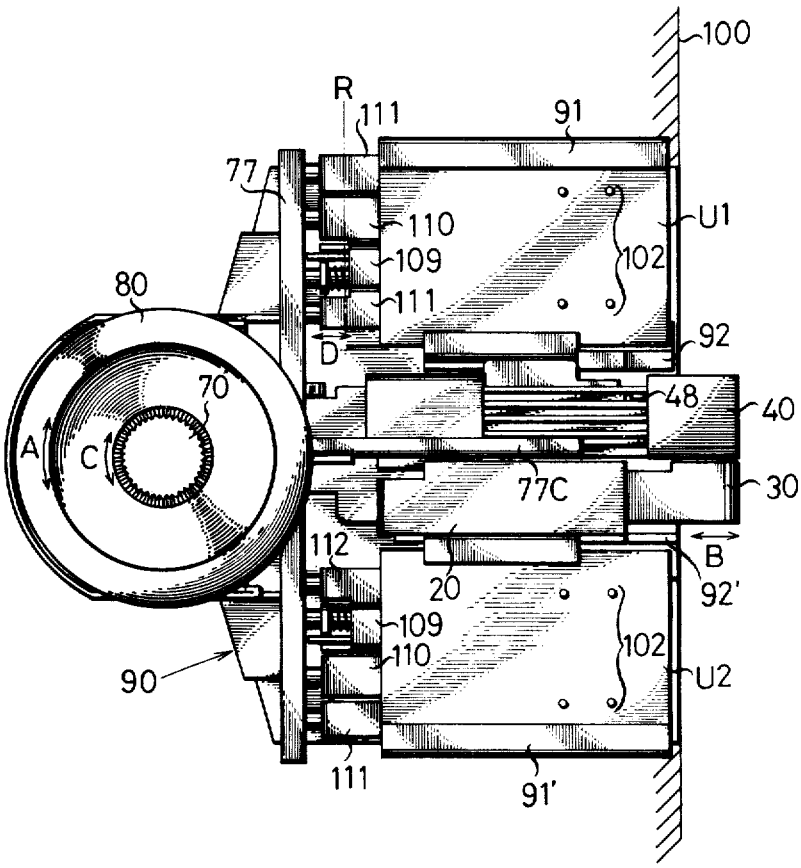
FIG. 9 is a front view of the lock device according to this invention.

In FIG. 9, the lock device according to the invention is shown as comprising a latch bolt operating mechanism operative to cause a latch bolt 30 to move as indicated by arrows B into and out of an end surface 100 of a door. A grip 90 for opening and closing the door is turned as indicated by arrows and a cartridge mechanism thus enables the lock units U1 and U2 to be individually detachably mounted therein. A dead bolt operating mechanism is operative to move the latch bolt operating mechanism to urge the dead bolt 40 into the end surface 100 of the door so long as the two lock units U1 and U2 are both in the inoperative position. An indoor unlocking mechanism permits the dead lock 40 to be freely operated from inside the room, and a resetting mechanism for restoring the lock units U1 and U2 to their standby position by moving a resetting lever 77 in one reciprocating motion is indicated by arrows D when a knob 70 is turned as indicated by an arrow C.

Figure 10:
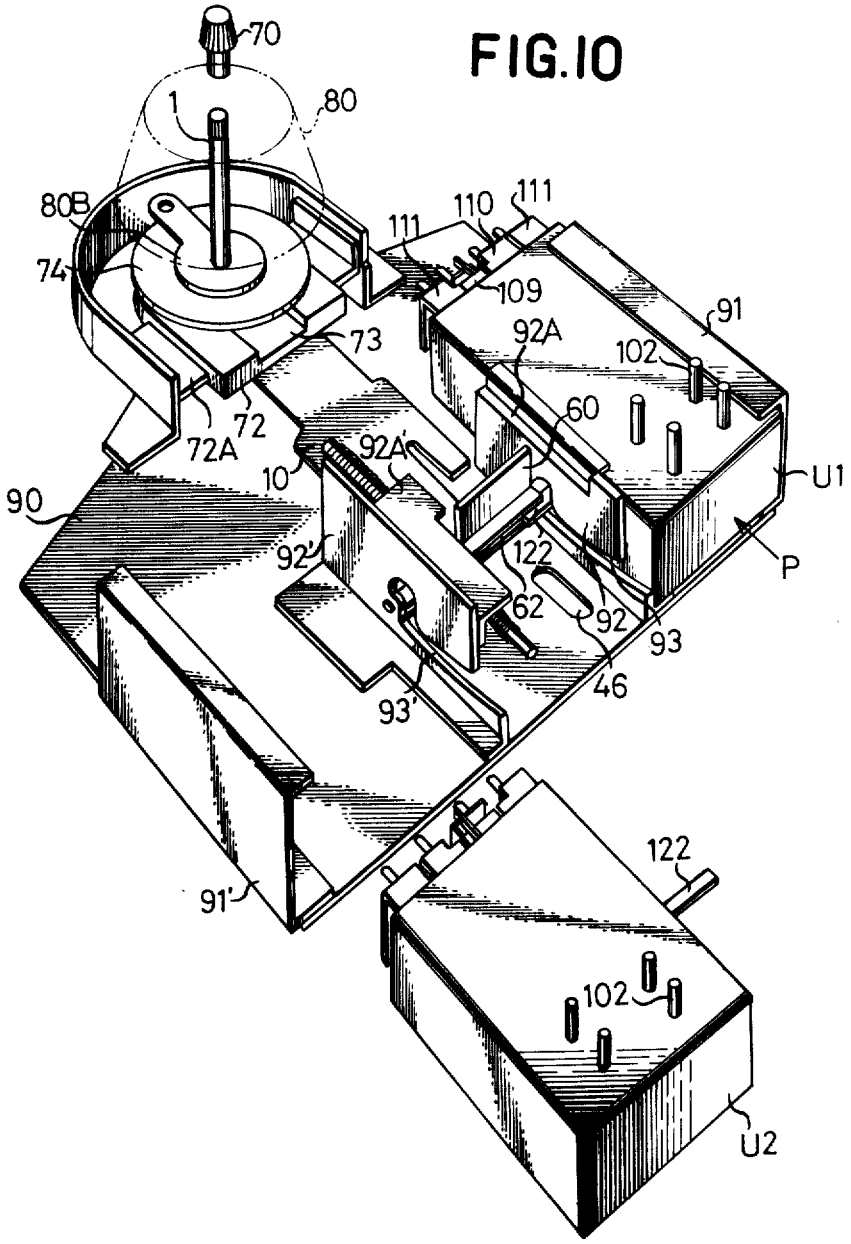
FIG. 10 is a perspective view of the lock device shown in FIG. 9, with the intermediate slider, latch bolt, control slider and dead bolt being removed.

Referring to FIGS. 9 and 10, a casing base plate 90 has on its upper surface two side plates 91 and 91' and two partition plates 92 and 92' which are located in parallel relation. The side plate 91 and the partition plate 92 define therebetween a space for mounting the lock unit U1, and the side plate 91' and the partition plate 92' define therebetween a space for mounting the lock unit U2. The lock units U1 and U2 are mounted in the respective spaces by being moved in the direction of an arrow P. Interposed between the two partition plates 92 and 92' is a locking and unlocking member 60 which is rotatably supported at opposite ends thereof by lower portions of the partition plates 92 and 92'. Formed in the lower portion of a surface of the locking and unlocking member 60 which is at a right angle to the direction in which the lock units are moved (as indicated by the arrow P) into their respective spaces on the casing base plate 90 is a fitting groove 62 which is oriented in the direction of the axis of rotation of the member 60 and which receives therein forward ends of the locking and unlocking bars 122 of the lock units U1 and U2. Each of the locking and unlocking bars 122 is brought to a position in which it is rotatable so long as the pushbuttons 102 of the lock units are depressed in a proper order to satisfy the unlocking requirements. However, since the two lock units U1 and U2 are interconnected through the locking and unlocking member 60, the locking and unlocking member 60 is incapable of rotating unless the unlocking requirements are met for the two lock units.

The locking and unlocking member 60 is held in engagement with the dead bolt 40 through a control slider 50 to be mentioned hereunder. Thus, even if the door grip 80 is turned, it is impossible to withdraw the dead bolt 40 from the mortise unless the two lock units are both in the inoperative position. The two partition plates 92 and 92' are formed therein with cutouts 93 and 93' respectively which are each downwardly inclined in a gentle curve for allowing the locking and unlocking bars 122 of the lock units U1 and U2 to move therethrough.

Latch Bolt Operating Mechanism

Figure 11:
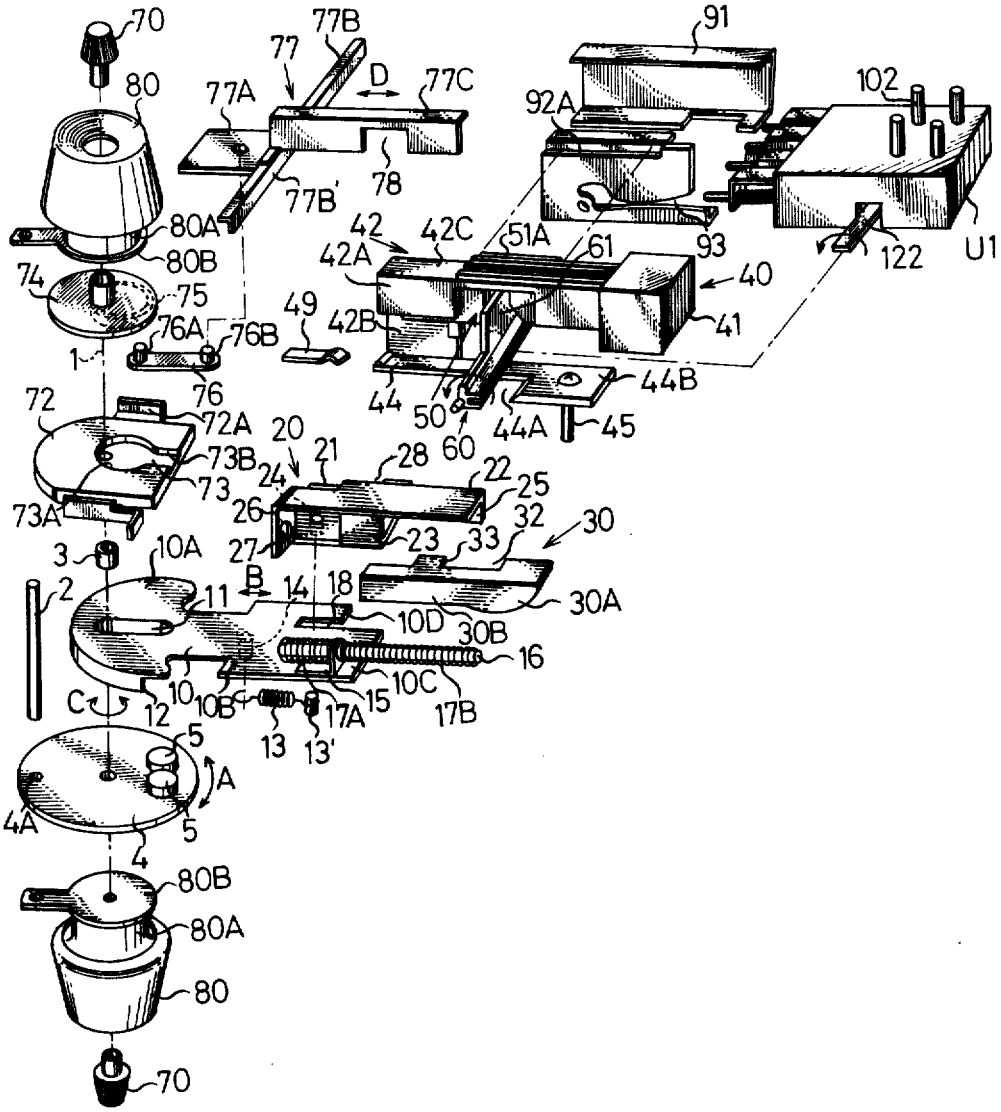
FIG. 11 is an exploded perspective view of the lock device according to this invention.

Referring to FIGS. 10 and 11, the grip 80 is supported at either end of a shaft 1 for rotation relative to the shaft 1. Each grip 80 includes an inwardly extending shaft portion 80A which has attached to its end surface a plate-like member 80B, and the two plate-like members 80B, 80B are interconnected by a connecting rod 2. A disk 4 rotatably supported by shaft 1 is interposed between the two grips 80, 80 and formed therein with an opening 4A through which the connecting rod 2 extends. That is, the grips 80, 80 and disk 4 are rotatable as a unit about shaft 1. The disk 4 is formed thereon with two ring-shaped pressure applying projections 5A and 5B which are located in a peripheral portion of the disk 4 in a position which is diametrically opposed to the opening 4A. The pressure applying projections 5A and 5B each consist of a projecting pin and a ring rotatably fitted thereover. It is to be understood that each ring may be fixed to the respective pin.

Figure 12:
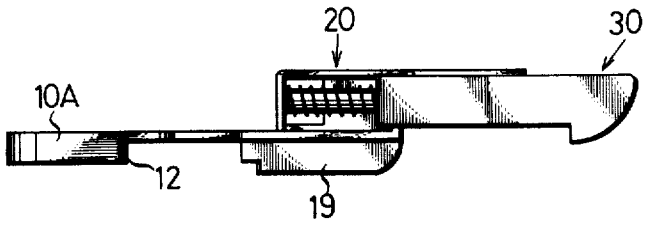
FIG. 12 is a front view showing the driving slider and the latch bolt in engagement with each other.
Figure 15:
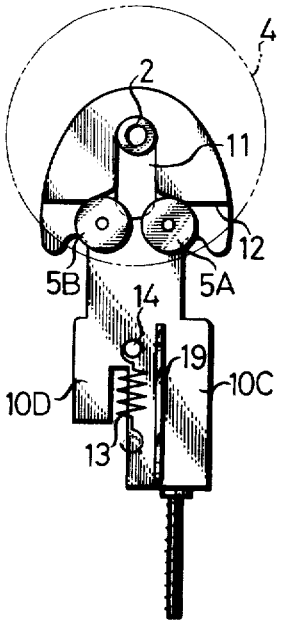
Figure 16:
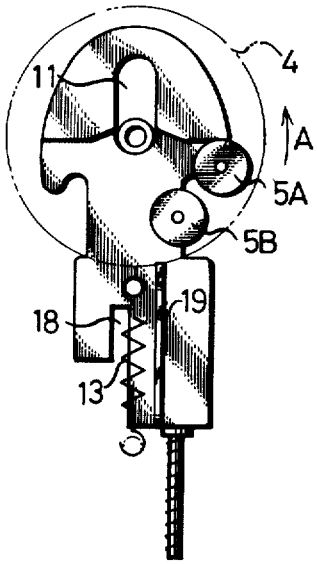

A driving slider 10 includes a head 10A which is located in juxtaposed relation to the portion of the surface of the disk 4 on which the projections 5A and 5B are located, and shaft 1 extends through a slot 11 formed in the head 10A. The numeral 3 designates a spacer ring. The head 10A of slider 10 has a larger thickness than the rest of the portions of the slider 10, so that angle-shaped offset portions 12 are formed on the underside of the head 10A of slider 10. The slider 10 also includes a leg 10C which is formed with a spacer 19 (See FIG. 12) of a thickness corresponding to the thickness of the offset portions 12, thereby to provide a clearance space for mounting a spring 13 which is connected between a pin 14 projecting from the underside of an intermediate portion 10B of slider 10 and the casing base plate 90 so as to urge the slider 10 to move rightwardly in FIG. 11. By this arrangement, the offset portions 12 of slider 10 are held at all times in contact with the peripheries of the projections 5A and 5B on the disk 4 (See FIG. 15). Thus, if the disk 4 is rotated in either direction, the slider 10 slides leftwardly in FIG. 11. This is because, if the disk 4 disposed in the position shown in FIG. 15, for example, is rotated, the projections 5A and 5B which have been disposed parallel to the offset portions 12 change their positions as the disk 4 rotates until they are disposed at a right angle to the offset portions 12 as shown in FIG. 16.

Mounted on the upper surface of the leg 10C of the driving slider 10 is a support member 15 to which a guide rod 16 is secured at its intermediate portion. The guide rod 16 is oriented in the direction in which the driving slider 10 moves in sliding motion, and has coil springs 17A and 17B mounted around it.

Figure 13:
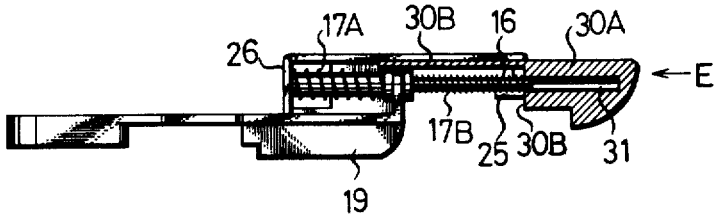
FIG. 13 is a front view, with certain parts being shown in section, of the driving slider and the latch bolt in engagement with each other.
Figure 14:
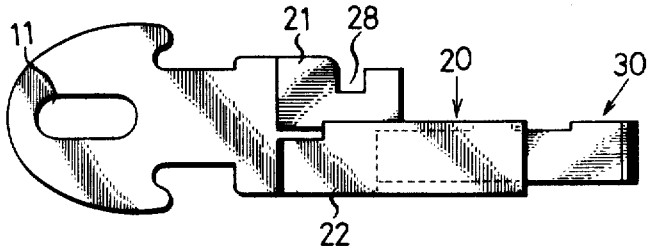
FIG. 14 is a top plan view of FIG. 13.

An intermediate slider 20 is slidably mounted on the upper surface of the driving slider 10 and includes a bottom wall 21 maintained in sliding contact with the upper surface of the driving slider 10, and a top wall 22 resting on an upper surface 92A' of the partition plate 92 shown in FIG. 10. The bottom wall 21 and the top wall 22 are connected together by an upright wall 23 in such a manner that the three walls are of a shape ⅃ in cross section. Projecting downwardly from the underside of the bottom wall 21 is a pin 24 which is positioned such that it is received in a cut-out 18 formed in the leg 10C of the driving slider 10 when the intermediate slider 20 is placed on the driving slider 10. The top wall 22 extends at one end portion thereof in a direction which is at a right angle to the bottom wall 21 and the upright wall 23 and is formed on the underside of its terminating portion with an L-shaped locking pawl 25 for restricting the range of sliding movement of the latch bolt 30 relative to the intermediate slider 20 and also for preventing the dislodging of the latch bolt 30. By moving upwardly the locking pawl 25 together with the top wall 22 of the intermediate slider 20, it is possible to remove the latch bolt 30 and replace it by an oppositely directed latch bolt. The top wall 22 has at the other end thereof a depending portion 26 which is bent downwardly in a manner to be in the form of a letter L in cross section when seen together with the top wall 22. The depending portion 26 is formed therein with a guide aperture 27. When the intermediate slider 20 is placed on the driving slider 10, the guide rod 16 is fitted in the guide aperture 27. Since the depending portion 26 of the intermediate slider 20 is urged to move by the biasing force of spring 17A, the intermediate slider 20 stops in a position in which the pin 24 abuts against the bottom of the guide cutout 18 (See FIG. 13). The driving slider 10 is formed by the guide cutout 18 with a second leg 10D which has a smaller length than the leg 10C and which is shaped such that its end edge coincides in position with the edge of the bottom wall 21 of the intermediate slider 20.

The latch bolt 30 includes a solid forward end portion 30A and a hollow rear portion 30B, with a hole 31 (See FIG. 13) being formed in the solid forward end portion 30A and extending axially from the hollow rear end portion 30B toward the forward end of the bolt 30. The guide rod 16 of the driving slider is loosely fitted in the hollow rear end position 30B together with spring 17B, while the forward end portion of the guide rod 16 is slidably fitted in the hole 31 in the forward end portion 30A. The spring 17B abuts at its forward end against the rear wall of the forward end portion 30A at the entrance to the hole 31. On the other hand, the upper surface of the latch bolt 30 is adapted to be guided by the underside of the upper wall 22 of the intermediate slider 20 so as to move smoothly relative to each other. The latch bolt 30 is formed with an engaging cutout 32 and an engaging portion 33 for restricting the range of movement thereof. The locking pawl 25 of the intermediate slider 20 is adapted to be positioned in the engaging cutout 32, and the engaging portion 33 is adapted to be positioned between the edge of the upright wall 23 and the locking pawl 25. Thus the latch bolt 30 normally stops in a position in which the engaging portion 33 abuts against the locking pawl 25 by the biasing force of spring 17B. However, if a force is exerted on the latch bolt 30 in the direction of an arrow E in FIG. 13, then the latch bolt 30 is guided by the guide rod 16 and moves against the biasing force of spring 17B of a relatively low spring tension into the end edge 100 of the door shown in FIG. 9.

If any of the grips 80 is turned, the disk 4 will rotate and cause the driving slider 10 to move leftwardly in sliding movement against the biasing force of spring 13 in FIG. 11. The direction of this sliding movement is determined by the position of a pin 13' secured to the casing base plate 90 and having one end of spring 13 connected thereto, the spacer 19 and the slot 11 formed in the driving slider 10. Since the depending portion 26 of the intermediate slider 20 is in engagement with the guide rod 16 on the side of the driving slider 10 at which spring 17A of a relatively high spring tension is located, the intermediate slider 20 is moved by the driving slider 10 in the same direction as the sliding movement of the latter. The engaging portion 33 of the latch bolt 30 is urged by the biasing force of spring 17B into engagement with the locking pawl 25 of the intermediate slider 20. Thus, the latch bolt 30 moves together with the intermediate slider 20 while maintained in this state. It will be seen, therefore, that by turning any one of the grips 80, it is possible to withdraw the latch bolt 30 from the mortise and move the same into the end edge 100 of the door shown in FIG. 9. The range of turning movement of the grips 80 is set by a stopper (not shown) provided to the casing base plate 90.

Dead Bolt Operating Mechanism

Referring to FIG. 11 and FIGS. 17 to 19, the dead bolt 40 includes a solid head 41 of a rectangular shape in cross section, and a stem portion 42 in the form of an inverted letter U connected to the head 41. The stem portion 42 has two side walls 42A and 42B which are formed with cutouts 43A and 43B respectively. The presence of these cutouts makes one side wall 42B extend further downwardly than the other side wall 42A so as to be connected to a base portion 44. The base portion 44 is formed along its side edge with a cutout 44A which extends halfway through the base portion 44, and a guide pin 45 projects downwardly from the underside of the base portion 44 in a portion thereof which is near to the head 41. The pin 45 is received in a slot 46 (See FIG. 10) formed in the casing base plate 90 when the dead bolt 40 is placed on the casing base plate 90. The dead bolt 40 is capable of moving in sliding motion leftwardly and rightwardly in FIG. 9 on the casing base plate 90 as the pin 45 moves in the slot 46. Portions of the driving slider 10 and intermediate slider 20 extend through a space defined by the side wall 42A of the stem portion 42 and the base portion 44 into the stem portion 42 of the dead bolt 40, and a cutout 28 formed at the forward end portion of the bottom wall 21 of the intermediate slider 20 is in engagement with a control pin 55 of a seesaw member 54 (FIG. 18) to be mentioned under. The spring 13 on the underside of the driving slider 10 and the pin 13' to which one end of spring 13 is connected are positioned in the cutout 44A in the base portion 44 of the dead bolt 40, so that the sliding movement of the dead bolt 40 is not prevented.

Figure 18:
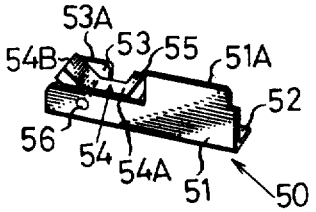
FIG. 18 is a perspective view of the control slider.
Figure 19:
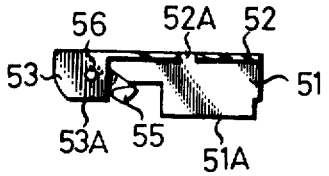
FIG. 19 is a rear view of the control slider.
Figure 20:
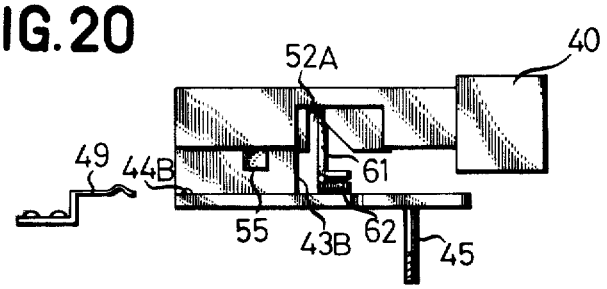
FIG. 20, FIG. 21 and FIG. 22 are views in explanation of the interlocking operation of the dead bolt, control slider, locking spring and locking and unlocking pawl.
Figure 24:
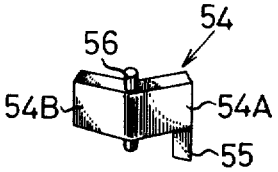
FIG. 24 is a perspective view of the seesaw member.

The control slider 50 which is in the form of a letter L in cross section as shown in FIGS. 18 and 19 is fitted in the stem portion 42 of the dead bolt 40 for sliding movement in an axial direction of the dead bolt 40. The control slider 50 includes a top wall 51 adapted to be brought into sliding contact with the underside of a top wall 42C of the stem portion 42, a side wall 52 adapted to be brought into sliding contact with the inner side surface of side wall 42A of the stem portion 42, and a lug 52 projecting from the rear portin of the side wall 52 in the same direction as the top wall 51. The lug 52 has a planar top portion 53A which is positioned against the inner surface of side wall 42B of the stem portion 42. Arranged between the lug 53 and side wall 52 is the seesaw member 54 of the V-shape in cross section (FIG. 24) which is pivotally supported through a shaft 56 by the side wall 52 and lug 53. An arm 54A positioned on the inner side of the seesaw member 54 has connected to its end portion a control pin 55 which projects downwardly. On the other hand, a control projection 47 of a semi-circular shape is formed on the side wall 42B of the stem portion 42 and located rearwardly of the cutout 43A, and the V-shaped seesaw member 54 is in contact at its inner side with the semi-circular control projection 47. The side wall 52 of the control slider 50 is formed therein with a cutout 52A (See FIG. 17) in which the forward end portion of a locking and unlocking pawl 61 is adapted to engage as shown in FIG. 20.

The top wall 51 of control slider 50 has a projecting portion 51A which is adapted to rest on a top 92A of the partition plate 92 shown in FIG. 11. The control slider 50 is guided by the top 92A in its sliding movement axially of the stem portion 42 of the dead bolt 40. The range of movement is restricted by the width of the cutout 43B(FIG. 20) formed in the side wall 42B of the stem portion 42 for receiving the projecting portion 51A of the control slider 51.

Figure 21:
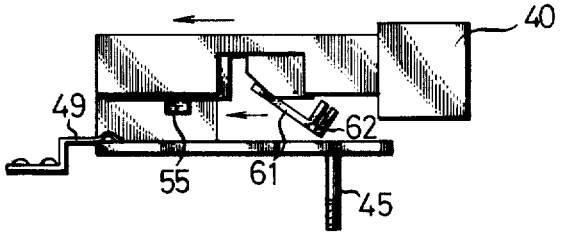
Figure 22:
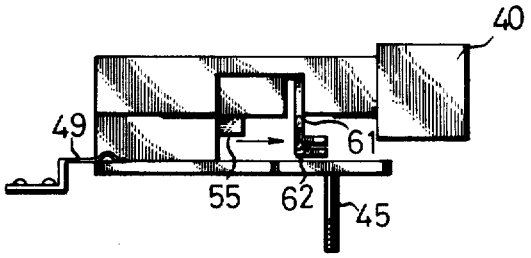
Figure 23:
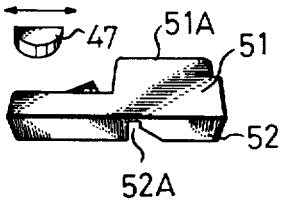
FIG. 23 is a schematic view showing the relative positions of the control projection formed in the dead bolt and the seesaw member of the control slider.

Operation of the dead bolt operating mechanism will be described with reference to FIGS. 20 and 21. For convenience of explanation, to two lock units U1 and U2 are assumed to be in the inoperative position so that the locking and unlocking member 60 can be rotated, and the dead bolt 40 is assumed to be in its forwardly projecting position as shown in FIG. 20. If any of the grips 80 is turned, the intermediate slider 20 will be caused by the driving slider 10 to move leftwardly in FIG. 11 as is the case when the latch bolt operating mechanism is operated as mentioned above. Since the control pin 55 of control slider 50 is in engagement within the cutout 28 of the bottom wall 21 of the intermediate slider 20, the control slider 50 is moved in the same direction. Because of the fact that the projecting portion 51A of the top wall 51 of the control slider 50 is in engagement with the side wall 42B of the stem portion 42 of the dead bolt 40, the dead bolt 40 moves together with the control slider 50. This results in a pawl 61 of the locking and unlocking member 60 moving rearwardly of the dead bolt 40 into an inclined position as shown in FIG. 21, so that the head 41 of the dead bolt 40 will move into the end edge 100 of the door. At this time, the latch bolt 30 also moves into the end edge 100 of the door. If the force exerted on the grip 80 is removed, the driving slider 10 will be restored to its original position by the biasing force of spring 13, and the control slider 50 will also be restored to its original position by being moved by the intermediate slider 20. However, since an elevated portion 44B formed near the rear end of the base portion 44 of the dead bolt 40 is engaged in a recess formed in a locking spring 49, the dead bolt 40 is held in the position shown in FIG. 21. That is, the dead bolt 40 remains in the position in the end edge 100 of the door, and the control slider 50 alone returns to its original position (FIG. 22). Thus, the door is unlocked.

In the event that either one of the lock units U1 and U2 is not in the inoperative position, the movement of the control slider 50 is prevented by the locking and unlocking pawl 61, so that it is impossible to move the dead bolt 40 into the end edge 100 of the door as mentioned above. In this case, since the intermediate slider 20 is in resilient engagement with the driving slider 10 through spring 17A, it is possible to slightly turn the grip 80 against the biasing force of spring 17A.

Indoor Unlocking Mechanism

Figure 26:
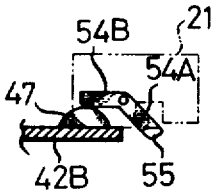
FIG. 25 and FIG. 26 are views showing the interlocking operation of the control projection and the seesaw member.
Figure 25:
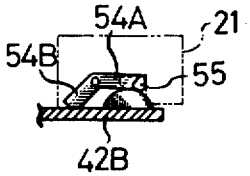

The dead bolt 40 can be moved freely by gripping a guide pin 45 projecting from the dead bolt 40 into the interior of the room, irrespective of the operation of the aforesaid mechanism. Operation of the indoor unlocking mechanism will be described with reference to FIGS. 23 to 26. When the control slider 50 is disposed in the rear portion of the dead bolt 40 as shown in FIG. 20, the seesaw member 54 mounted on the control slider 50 is positioned in such a manner that an inner arm 54A thereof rides on a control projection 47 on the dead bolt 40 and the control pin 55 extends inwardly from the side wall 42B of the dead bolt 40 as shown in FIG. 25. However, when the control slider 50 is disposed at the end of the forward portion or head of the dead bolt 40 as shown in FIG. 22, the seesaw member 54 is positioned such that an outer arm 54B thereof rides on the control projection and the control pin 55 is withdrawn from the inner planar surface of the side wall 42B of the dead bolt 40 as shown in FIG. 26. Stated differently, when the dead bolt 40 is in its forwardly projecting position as shown in FIG. 20, the control slider 50 is also in a forwardly projecting position (FIG. 25) in which it engages the cutout 28 of the intermediate slider 20. However, when the dead bolt 40 is moved to its rearwardly withdrawn position as shown in FIG. 22, the control slider 50 is released from engagement with the intermediate slider 20, with the result that the control slider 50 is operatively disconnected to the grips 80. If the dead bolt 40 located in this position is moved to the forwardly projecting position shown in FIG. 20, then the control slider 50 is brought into engagement with the cutout 28 of the intermediate slider 20 again. Thus, the dead bolt 40 is restored to a position from which it cannot be brought to its rearwardly withdrawn position unless the lock units U1 and U2 are both brought to the operative position. If the control pin 55 is constructed such that it is triangular in shape in cross section as shown in FIG. 25, then it is possible to minimize the angle of rotation of the seesaw member 54 because different sides of the triangular pin 55 will be used as engaging surfaces alternately.

Resetting Mechanism

Referring to FIGS. 10 and 11 again, a receiver 72 formed on its upper surface with a recess 73 of the horse-shoe shape is located over the head 10A of the driving slider 10 between the two grips 80. A disk 74 rests on the receiver 72 which is secured through upwardly projecting portions 72A thereof to the casing base plate 90. The shaft 1 extends through the recess 73 of the horse-shoe shape of the receiver 72 in a position which is near the edge of a circular portion 73A of the recess 73 remote from a head 73B, so that the shaft 1 and receiver 72 are capable of rotation relative to each other. The disk 74 is secured to the shaft 1 and has mounted on one of its two surfaces or the surface juxtaposed against the receiver 72 an eccentric ring 75 which is eccentric with respect to the shaft 1. The eccentric ring 75 is positioned such that it partly covers the circular portion 73A of the recess 73 of the horse-shoe shape. Located in a space defined by the recess 73 and the ring 75 is a projection 76A located at one end of a crank lever 76 arranged in the recess 73 which projection 76A is capable of coming into engagement with the inner periphery of the eccentric ring 75. The crank lever 76 has another projection 76B at the other end thereof which projection 76B extends outwardly from the head 73B of the recess 73 of the horse-shoe shape and is rotatably connected to a head 77A of the reset lever 77. The reset lever 77 includes a leg 77C and two reset arms 77B and 77B' extending symmetrically in opposite directions from the leg 77C. As shown in FIG. 9, the leg 77C is interposed between the intermediate slider 20 and the dead bolt 40 and adapted to be guided by them in its sliding movement in a lengthwise direction (in the directions of an arrow D). To enable this sliding movement of the reset lever 77, the leg 77C of the reset lever 77 is formed with a cutout 78 in which the locking and unlocking pawl 61 is located. The reset lever 77 includes a head 77A which is interposed between the receiver 72 and the disk 74 and adapted to come into engagement with the outer periphery of the eccentric ring 75.

Figure 27:
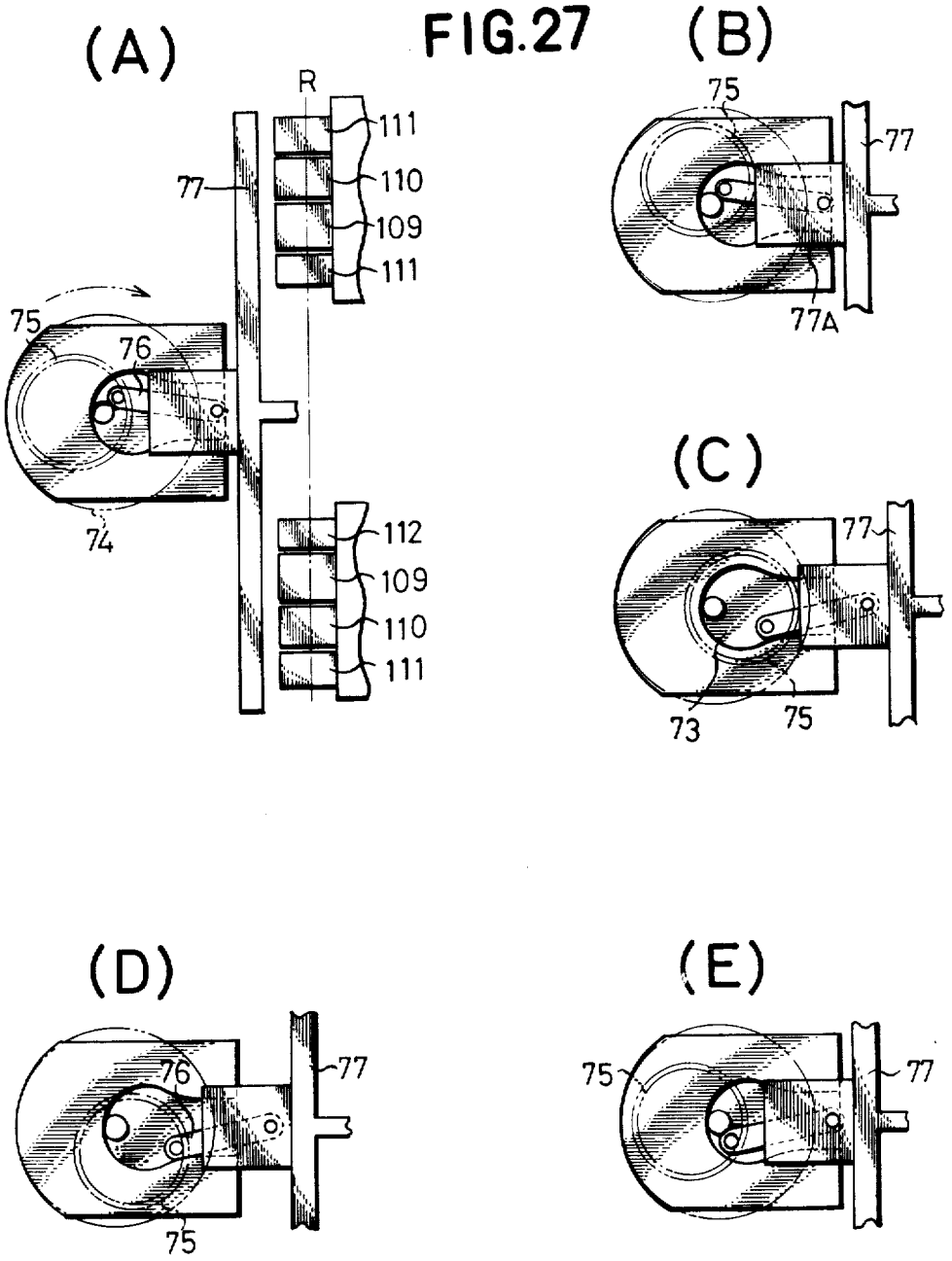
FIG. 27 is a view showing the operation of the resetting mechanism.

Operation of the resetting mechanism constructed as mentioned above will be described with reference to FIG. 27. For convenience of explanation, the eccentric ring 75 and crank lever 76 are assumed to be in positions shown in FIG. 27(A) and the reset lever 77 is assumed to be located in a position in which it is most remote from the lock units U1 and U2.

If one of the knobs 70 is turned from inside or outside the door, the second disk 74 is rotated through the shaft 1 in the direction of an arrow shown in FIG. 27(A), for example. This brings the outer periphery of the eccentric ring 75 into abutting engagement with the head 77A of the reset lever 77 as shown in FIG. 27(B). Further rotation of the disk 74 causes the eccentric ring 75 to push the reset lever 77 and move the same toward the lock units U1 and U2, until the reset arms 77B and 77B' are brought into contact with the rear ends of the driving and driven elements 109 and 110 and the preventing and releasing elements 111 and 112 of the two lock units U1 and U2. The reset arms 77B and 77B' move these elements at least to a reset position R shown in FIG. 9. The reset lever 77 finally reaches a position shown in FIG. 27(C) in which it projects farthest from the receiver 72 and in which the eccentric ring 75 can move the reset lever 77 no further. If the knob 70 is further turned in the same direction, the projection 76A at one end of the crank lever 76 is brought into engagement with the inner periphery of the eccentric ring 75, so that the reset lever 77 is moved through the crank lever 76 in a direction in which the lever 77 moves away from the lock units U1 and U2 as shown in FIG. 27(D). Finally, if the projection 76A at one end of the crank lever 76 is brought into engagement with a side of the shaft 1 substantially opposite the side at which the projection 76A is in engagement with the shaft 1 as shown in FIG. 27(A), then it is impossible to turn the knob 70 any further as shown in FIG. 27(E). Thus the reset lever 77 returns to the position shown in FIG. 27(A). This one reciprocating movement of the reset lever 77 resets the driving and driven lever 109 and 110 and the preventing and releasing lever 111 and 112 of the two lock units U1 and U2 in the standby position. Thus these elements remain in the reset position R.

Figure 28:
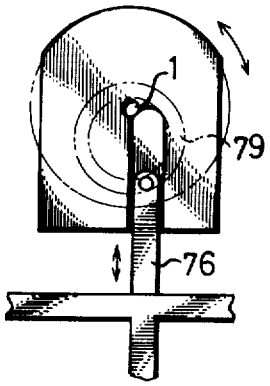
FIG. 28 is a schematic view of a modification of the resetting mechanism.
Figure 17:
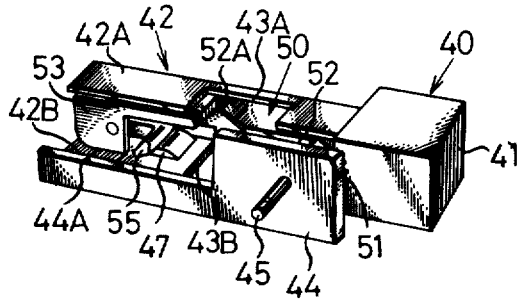
FIG. 17 is a perspective view of the dead bolt and the control slider fitted therein.

In the aforesaid construction, the head 77A of the reset lever 77 is pushed back by the outer peripheral edge of the eccentric ring 75. However, as shown in FIG. 28, an eccentric annular groove 79 may be formed on the underside of the disk 74 in place of the eccentric ring 75, and the projection at the rear end of the crank lever 76 may be engaged in the eccentric annular groove 79. By this arrangement, it is possible to cause the crank lever 76 to move forwardly and rearwardly merely by virtue of the engagement of the projection at the rear end of the crank lever 76 with the eccentric annular groove 79. The crank lever 76 is secured to the lever 77.

The lock device according to the present invention has all the functions which lock device generally used nowadays possess. An additional advantage is that the lock units U1 and U2 are interchangeable and readily withdrawn from and fitted in the casing base plate 90. Thus, if a number of different types of lock units which provide different requirements for rendering the lock units inoperative are prepared and supplied to the user, it is possible for the user of the lock device to change, when necessary, the requirements for rendering the lock units inoperative or for opening the door, for example, so that the order in which the pushbuttons should be depressed will not be known to anyone except the user.

In the embodiment shown and described above, two lock units U1 and U2 are used. However, it is to be understood that the invention is not limited to this number of the lock units and that the lock units of any number as desired can be used. For example, if lock units each constructed to have the locking and unlocking bar 122 projects on opposite sides of the unit are arranged on outer sides of the two lock units U1 and U2 and the locking and unlocking bars of these lock units are suitably combined with one another, it is possible to use more than three lock units.

As shown in FIG. 9, the dead bolt 40 is formed in the top wall 42C thereof with a small opening 48 which is disposed in one of a plurality of slots formed in the top wall 42C. When the lock device becomes faulty, an opening may be formed in the casing so that a probe can be inserted therethrough into engagement with the small opening 48 manually to pull out the dead bolt 40 from the mortise. It is necessary that the opening in the casing should be formed exactly in a position which coincides with the slot formed with the small opening 48. Thus, it is only the person who knows the position of the slot in which the small opening 48 is formed that can break open the lock device as by using a drill.

What we claim is:

1. A lock device of the pushbutton system comprising:

at least one lock unit adapted to permit a locking and unlocking bar to rotate when pushbuttons of a number *r* out of a total number *n* are depressed in a manner to meet the requirements for rendering the lock unit inoperative to fasten a door;

a restoring mechanism for returning the lock unit to a standby position;

a locking and unlocking pawl coupled to the locking and unlocking bar of the lock unit;

a dead bolt engaged with said locking and unlocking pawl;

a dead bolt operating mechanism operative to permit the dead bolt for fastening the door to be operated by turning one of two grips of the door so long as the aforesaid requirements for rendering the lock unit inoperative to fasten the door are met, said dead bolt operating mechanism comprises a control slider located in said dead bolt for sliding movement axially thereof, an intermediate slider held in engagement with said control slider, and means for moving said intermediate slider as one of the two grips of the door is operated.

2. A lock mechanism as claimed in claim 1, wherein said means for moving said intermediate slider as one of the two grips of the door is operated comprises a driving slider in engagement with the intermediate slider, a first spring operative to urge said driving slider to move in a predetermined direction by its biasing force, two offset portions of the angle shape arranged in adjacent relation and located on a head of the driving slider, a first disk disposed adjacent the head of the driving slider in juxtaposed relation and adapted to rotate as one of the two grips of the door is turned, and two pressure applying projections located in side-by-side relation on the surface of said first disk and adapted to engage said offset portions of the angle shape, said pressure applying projections being operative to move said driving slider upon rotation of said first disk.

3. A lock device as claimed in claim 2, wherein said intermediate slider is held in resilient engagement with said driving slider by the biasing force of a second spring.

4. A lock device as claimed in claim 2, further comprising a latch bolt supported on the driving slider and moved by the biasing force of a third spring, said intermediate slider restricting the range of movement of the latch bolt.

5. A lock device as claimed in claim 1, wherein the control slider has mounted thereon a seesaw member in the form of a letter V capable of engagement with the intermediate slider through a control pin attached to one arm thereof, said seesaw member being in contact at its inner side with a control projection securely fixed in the dead bolt and said control pin being released from engagement with the intermediate slider when the dead bolt is moved relative to the seesaw member in a direction opposite to the forwardly projecting direction thereof.

6. A lock device as claimed in claim 5, wherein said control pin is triangular in cross-sectional shape and one of the sides of the control pin drops outwardly from an inner wall of the dead bolt when the latter is moved in its projecting direction relative to the control slider.

7. A lock device as claimed in claim 5, wherein the dead bolt is formed in one of a plurality of slots formed in a top wall thereof with a small opening, so that when the lock device becomes faulty an opening can be formed in an upper cover of a casing and a probe can be inserted through this opening into engagement with the opening in the top wall of the dead bolt to render the dead bolt inoperative to fasten the door.

8. A lock device the pushbutton system comprising:

at least one lock unit adapted to permit a locking and unlocking bar to rotate when pushbuttons of a number $r$ out of a total number $n$ are depressed in a manner to meet the requirements for rendering the lock unit inoperative to fasten a door;

a restoring mechanism for returning the lock unit to a standby position;

a locking and unlocking pawl coupled to the locking and unlocking bar of the lock unit;

a dead bolt engaged with said locking and locking pawl;

a dead bolt operating mechanism operative to permit the dead bolt for fastening the door to be operated by turning one of two grips of the door so long as the aforesaid requirements for rendering the lock unit inoperative to fasten the door are met, said restoring mechanism for returning the lock unit to a standby position comprises a receiver formed on one surface thereof with a recess of the horse-shoe shape, a second disk disposed in juxtaposed relation to said receiver and adapted to be rotated by one of said grips, a ring located on a surface of said second disk juxtaposed against said receiver and disposed eccentrically with respect to the center of rotation of the second disk, a lever located in said recess of the horse-shoe shape on said receiver and has one end in engagement with an inner wall surface of the ring so as to be moved by said engagement, and a reset level in engagement with the other end of said lever adapted to move when said reset lever moves so that driving and driven elements and preventing and releasing elements of the lock unit can be returned to the standby position.

9. A lock device as claimed in claim 8, wherein said reset lever includes a head adapted to come into contact with an outer periphery of said disk.

10. A lock device as claimed in claim 8, wherein said one end of the lever located in the recess of the horse-shoe shape is circular in shape and has projection thereon.

* * * * *